US006191526B1

(12) United States Patent
Minder et al.

(10) Patent No.: US 6,191,526 B1
(45) Date of Patent: Feb. 20, 2001

(54) ELECTRIC LAMP HAVING A CURRENT LEAD-IN WIRE WITH A FLATTENED U-SHAPED END SEGMENT

(75) Inventors: Rolf Minder, Nattheim; Rolf Kiesel, Aalen, both of (DE)

(73) Assignee: Patent-Treuhand-Gesellschaft fuer elektrische Gluehlampen mbH, Munich (DE)

( * ) Notice: Under 35 U.S.C. 154(b), the term of this patent shall be extended for 0 days.

(21) Appl. No.: 09/202,086

(22) PCT Filed: Nov. 11, 1997

(86) PCT No.: PCT/DE97/02639

§ 371 Date: Dec. 8, 1998

§ 102(e) Date: Dec. 8, 1998

(87) PCT Pub. No.: WO98/48448

PCT Pub. Date: Oct. 29, 1998

(30) Foreign Application Priority Data

Apr. 18, 1997 (DE) ..... 197 16 158

(51) Int. Cl.[7] ..... H01J 5/50

(52) U.S. Cl. ..... 313/331; 313/333; 313/271

(58) Field of Search ..... 313/271, 331, 313/333, 578

(56) References Cited

U.S. PATENT DOCUMENTS

| | | | |
|---|---|---|---|
| 2,145,186 | | 1/1939 | Meeker et al. . |
| 2,315,504 | | 4/1943 | Curtis . |
| 3,780,333 | | 12/1973 | Flynn . |

FOREIGN PATENT DOCUMENTS

| | | | | |
|---|---|---|---|---|
| 690 735 | | 4/1940 | (DE) . | |
| 5-182641 | * | 7/1993 | (JP) | H01K/1/16 |
| 6-231736 | * | 8/1994 | (JP) | H01K/1/40 |

* cited by examiner

*Primary Examiner*—Nimeshkumar D. Patel
*Assistant Examiner*—Karabi Guharay
(74) *Attorney, Agent, or Firm*—Frishauf, Holtz, Goodman, Langer & Chick, P.C.

(57) ABSTRACT

The invention relates to the fastening of incandescent coil filaments to current lead-in wires in electric lamps. One end (41) of the current lead-in wires is flattened and U-shaped. The U-shaped segment (41) of the current lead-in wire forms a gap-like seat (45) for a coiled incandescent coil-filament end **(3*a*), the gap width of which is smaller than the outside diameter of the incandescent coil-filament end (3*a*)**.

16 Claims, 2 Drawing Sheets

ELECTRIC LAMP HAVING A CURRENT LEAD-IN WIRE WITH A FLATTENED U-SHAPED END SEGMENT

The invention relates to an electric lamp with a lamp bulb and at least one incandescent coil filament disposed in the lamp bulb as well as with electric current leads connected to the incandescent coil filament.

BACKGROUND OF THE INVENTION

An electric lamp of such type is disclosed, for example, in Japanese Utility Model 49-37 422. This utility model describes how an incandescent coil filament is fastened on a current lead-in wire provided with a flattened, U-shaped end. In their connection region the two legs of the U have reduced wire thickness and thereby form a seat, which is matched to the coil-filament diameter and in which there is disposed an uncoiled end of the incandescent coil filament. Outside the seat the two legs of the U are in contact with each other, and so the seat for the uncoiled end of the incandescent coil filament resembles the eye of a needle.

SUMMARY OF THE INVENTION

The object of the invention is to provide an electric lamp with improved fastening between incandescent coil filament and its current lead.

In the electric lamp according to the invention, the incandescent coil filament is fastened and provided with electrical contacts by means of current lead-in wires having a flattened, U-shaped end. The two legs of the U-shaped current lead-in wire segment form a gap in which a coiled end of the incandescent coil filament is disposed. The gap width is smaller than the outside diameter of the coiled end of the incandescent coil filament, and so the incandescent coil filament is held clampingly in the gap-like seat. The gap width is advantageously 60 to 90% and preferably 70% of the outside diameter of the coiled end of the incandescent coil filament. Thereby there is achieved secure fixing of the incandescent coil filament to the current lead with only slight deformation of the coil filament. In order to prevent bending or opening of the legs of the U, the ends of the legs of the U are advantageously welded together with each other in two practical examples of the invention, while in a further practical example the end of the free leg of the U is welded together with the non-flattened segment of the current lead-in wire for this purpose. In a preferred practical example (FIG. 4), the free leg of the U has an angled end, which is welded together with the other leg of the U. Thereby the gap width can be varied within certain limits for given wire thickness and degree of flattening of the current lead-in wire. The end of the incandescent coil filament projecting beyond the legs of the U is advantageously welded together with the current lead-in wire. Thereby there is achieved good electrical contact and low contact resistance between incandescent coil filament and current lead-in wire. The invention is suitable in particular for fastening doubly coiled incandescent coil filaments having singly coiled ends.

BRIEF DESCRIPTION OF THE DRAWINGS

The invention will be explained in more detail hereinafter by reference to several preferred practical examples, wherein.

DETAILED DESCRIPTION

Figure 1:
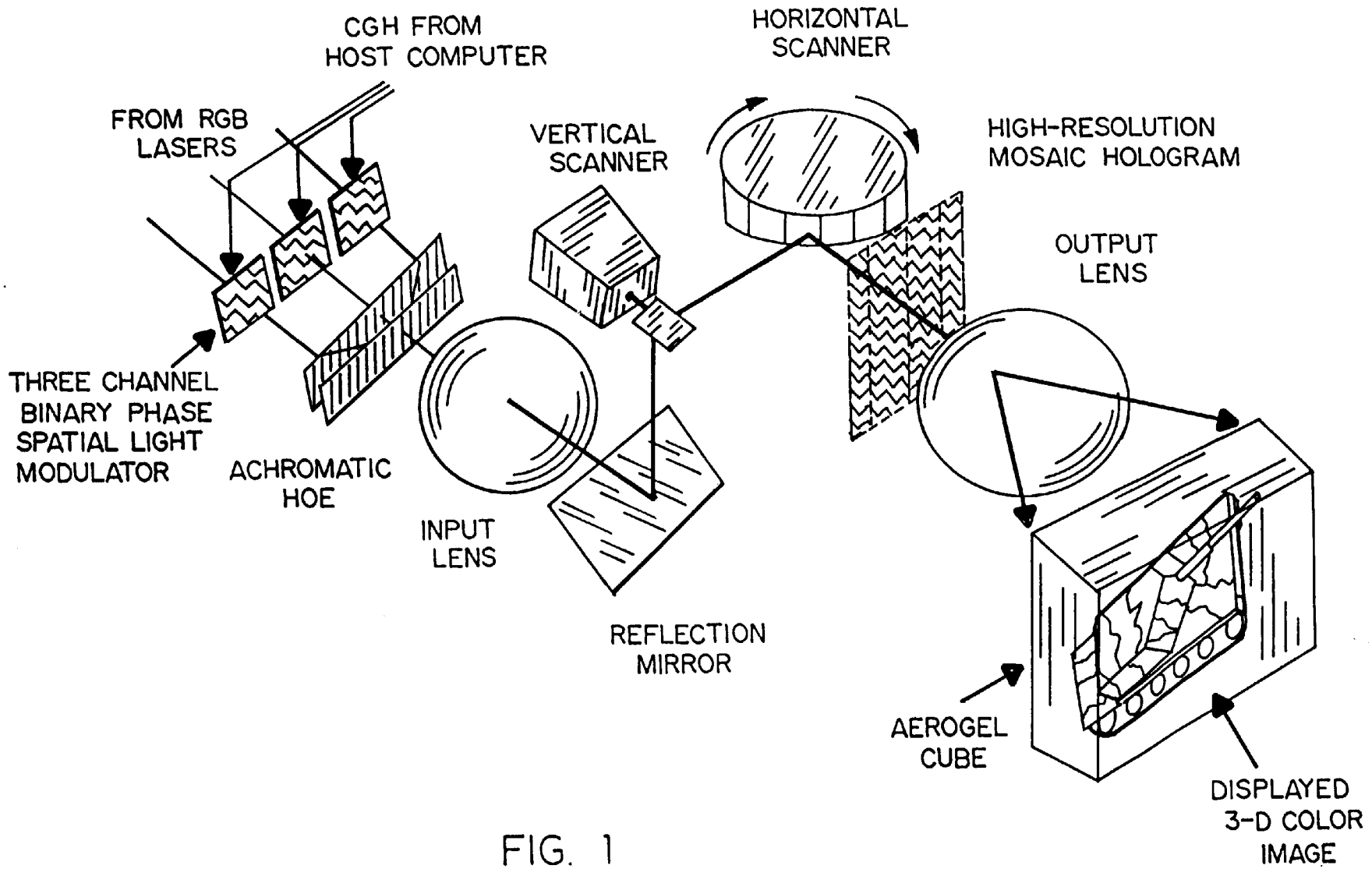
FIG. 1 shows a schematic diagram of an electric incandescent filament lamp with the coil-filament fastening according to the invention

FIG. 1 shows a schematic diagram of an electric incandescent lamp with the coil-filament fastening according to the invention. This incandescent lamp has a glass lamp bulb 1, a bayonet base 2 and a doubly coiled incandescent coil filament 3 enclosed in the lamp bulb 1, said filament being held and provided with electrical contacts by means of two current lead-in wires 4, 5 fused into a glass bead 6. For fixation of the incandescent coil filament 3, the ends 4*a*, 5*a* of the current lead-in wires 4, 5 are flattened and U-shaped. Each end of the incandescent coil filament 3 is only singly coiled, and is held by the U-shaped segment 4*a*, 5*a* of a current lead-in wire 4, 5. In this respect all four practical examples are identical.

Figure 2:
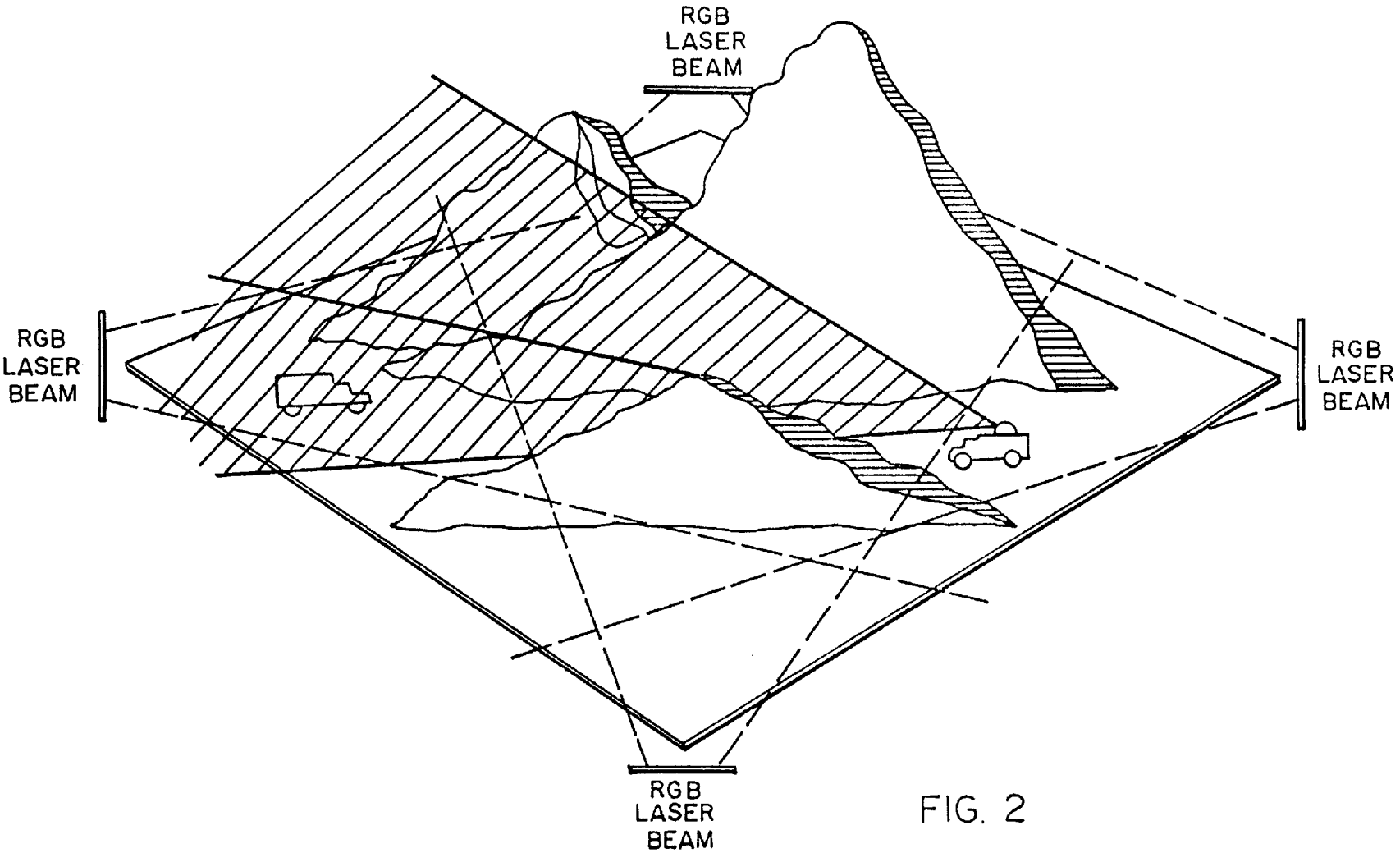
FIG. 2 shows a schematic diagram of a side view of the U-shaped end of a current lead-in wire and of the coil-filament end fixed thereto according to the first practical example of the invention
Figure 1:
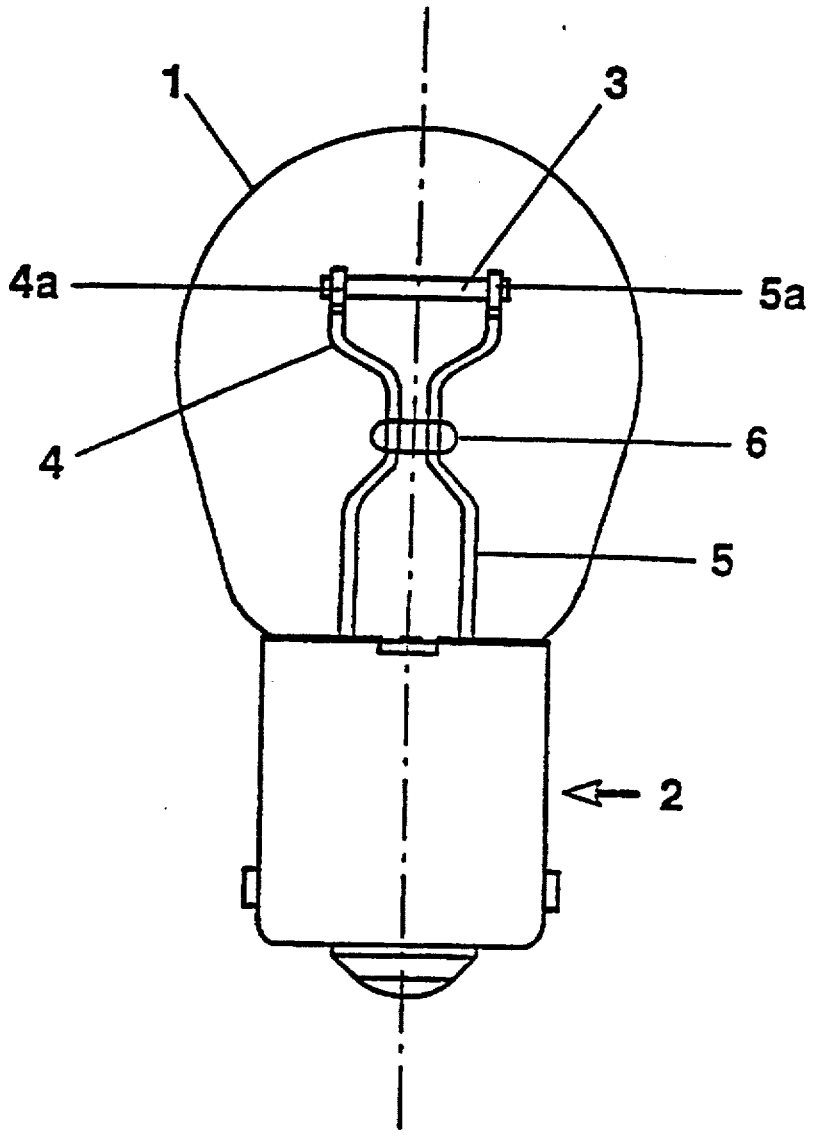
Figure 2:
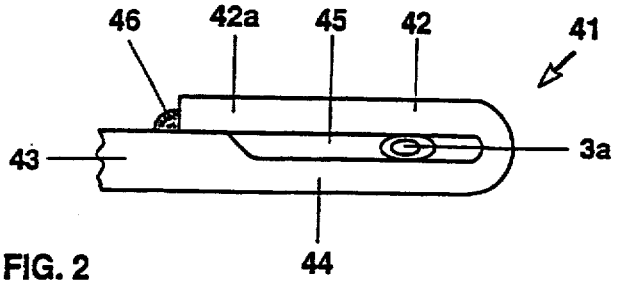

FIG. 2 shows a first practical example of the current lead-in wire 4 or 5 from FIG. 1 with the coil-filament end fastened thereto. The end 41 of this current lead-in wire is flattened and U-shaped, so that the U-shaped segment 41 has a free leg 42 as well as a leg 44 attached to the non-flattened segment 43 of the current lead-in wire. The end 42*a* of the free leg 42 of the U is joined to the non-flattened segment 43 of the current lead-in wire by a weld spot 46. Thereby the two flattened legs 42, 44 of the U define a gap 45, in which there is disposed a singly coiled end 3*a* of the incandescent coil filament 3 by clamping action. The width of the gap 45 is determined by the flattening of the current lead-in wire. This is chosen in such a way as to ensure that the gap width corresponds to about 70% of the outside diameter of the singly coiled end 3*a* of the incandescent coil filament. This means that the singly coiled end 3*a* of the incandescent coil filament 3 is compressed to approximately 70% of its original outside diameter in the gap 45. The coil filament end projecting beyond the U-shaped segment 41 is welded together with the current lead-in wire. This type of coil-filament fastening is suitable for incandescent coil filaments 3 in which the coiled ends 3*a* of the coil filaments have an outside diameter of up to 700 $\mu$m. The current lead-in wires 4, 5 have a diameter or a wire thickness of between 0.4 mm and 0.8 mm in the non-flattened segment 43.

Figure 3:
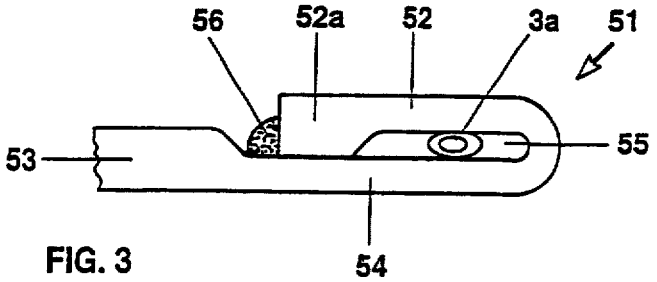
FIG. 3 shows a schematic diagram of a side view of the U-shaped end of a current lead-in wire and of the coil-filament end fixed thereto according to the second practical example of the invention

FIG. 3 shows a second practical example of the current lead-in wire 4 or 5 with the coil-filament end fastened thereto. The end 51 of the current lead-in wire is flattened and U-shaped, so that the U-shaped segment 51 has a flattened free leg 52 as well as a flattened leg 54 attached to the non-flattened segment 53 of the current lead-in wire. However, the end 52*a* of the free leg 52 of the U is not flattened. This end 52*a* has the same diameter or the same wire thickness as the non-flattened segment 53 of the current lead-in wire. The non-flattened end 52*a* of the free leg 52 of the U is joined to the other leg 54 of the U by a weld spot 56. Thereby the two flattened legs 52, 54 of the U define a gap 55, in which there is disposed a singly coiled end 3*a* of the incandescent coil filament 3 by clamping action. The width of the gap 55 is determined by the flattening of the current lead-in wire. It is chosen in such a way as to ensure that the gap width corresponds to about 70% of the outside diameter of the singly coiled end 3*a* of the incandescent coil filament. This means that the singly coiled end 3*a* of the incandescent coil filament in the gap 55 is compressed to approximately 70% of its original outside diameter. The coil filament end projecting beyond the U-shaped segment 51 is welded together with the current lead-in wire. This type of coil-filament fastening is suitable for incandescent coil filaments 3 in which the coiled ends 3*a* of the coil filaments have an outside diameter of up to 700 $\mu$m. The current lead-in wires 4, 5 (FIG. 1) have a diameter or a wire thickness of between 0.4 mm and 0.8 mm in the non-flattened segment 53.

Figure 4:
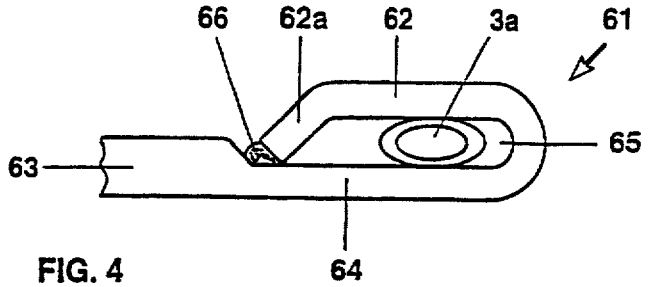
FIG. 4 shows a schematic diagram of a side view of the U-shaped end of a current lead-in wire and of the coil-filament end fixed thereto according to the third practical example of the invention

FIG. 4 shows a third practical example of the current lead-in wire 4 or 5 with the coil-filament end fastened thereto. The end 61 of the current lead-in wire is flattened and U-shaped, so that the U-shaped segment 61 has a flattened free leg 62 as well as a flattened leg 64 attached to the non-flattened segment 63 of the current lead-in wire. The end 62*a* of the free leg 62 of the U is angled down therefrom and joined to the end of the other leg 64 of the U by a weld spot 66. Thereby the two flattened legs 62, 64 of the U define a gap 65, in which there is disposed a singly coiled end 3*a* of the incandescent coil filament 3 by clamping action. In contrast to the two preceding practical examples, the width of the gap 65 in this case is not determined solely by the degree of flattening of the current lead-in wire, but also depends on the length of the angled end 62*a* of the free leg 62 of the U and on the angle that the angled end 62*a* includes with the leg 62 of the U. By increasing this angle, the width of the gap 65 is adjusted in such a way as to ensure that it corresponds to about 70% of the outside diameter of the singly coiled end 3*a* of the incandescent coil filament. This means that the singly coiled end 3*a* of the coil filament clamped in the gap 65 is compressed to approximately 70% of its original outside diameter. The coil filament end projecting beyond the U-shaped segment 61 is welded together with the leg 64 of the U. The angle between the free leg 62 of the U and its angled. End 62*a* is about 45° before shaping of the U-shaped segment 61 and before clamping of the end of the incandescent coil filament. The angle is widened during clamping of the coil filament 3 between the two legs 62, 64 of the U. This type of coil-filament fastening is suitable for incandescent coil filaments 3 in which the coiled ends 3*a* of the coil filaments have an outside diameter of up to 2 mm. The current lead-in wires 4, 5 (FIG. 1) have a diameter or a wire thickness of between 0.4 mm and 0.8 mm in the non-flattened segment 63.

Figure 5:
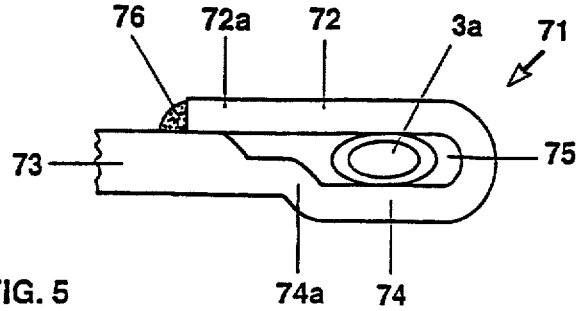
FIG. 5 shows a schematic diagram of a side view of the U-shaped end of a current lead-in wire and of the coil-filament end fixed thereto according to the fourth practical example of the invention.

FIG. 5 shows a fourth practical example of the current lead-in wire 4 or 5 with the coil-filament end fastened thereto. The end 71 of the current lead-in wire is flattened and U-shaped, so that the U-shaped segment 71 has a flattened free leg 72 as well as a flattened leg 74 attached to the non-flattened segment 73 of the current lead-in wire. At its end 74*a* attached directly to the non-flattened segment 73 of the current lead-in wire, the leg 74 of the U has step-like shape. The end 72*a* of the free leg 72 of the U is joined to the non-flattened segment 73 of the current lead-in wire by a weld spot 76. Thereby the two flattened legs 72, 74 of the U define a gap 75, in which there is disposed a singly coiled end 3*a* of the incandescent coil filament 3 by clamping action. The end of the leg 74 of the U connected to the non-flattened segment 73 of the current lead has the form of a step 74*a*, via which this end of the leg 74 of the U is formed on the non-flattened segment 73. The width of the gap 75 is determined by the degree of flattening of the U-shaped segment 71 of the current lead-in wire and by the height of the step 74*a*. It is chosen in such a way as to ensure that the width of the gap 75 corresponds to about 70% of the outside diameter of the singly coiled end 3*a* of the incandescent coil filament. This means that the singly coiled end 3*a* of the incandescent coil filament 3 is compressed to approximately 70% of its original outside diameter in the gap 75. The coil filament end projecting beyond the U-shaped segment 71 is welded together with the current lead-in wire. This type of coil-filament fastening is suitable for incandescent coil filaments 3 in which the ends 3*a* of the coil filaments have an outside diameter of up to 2 mm. The current lead-in wires 4, 5 (FIG. 1) have a diameter or a wire thickness of between 0.4 mm and 0.8 mm in the non-flattened segment 73.

In all practical examples explained in the foregoing, the wire thickness of the flattened U-shaped wire segment 41, 51, 61, 71 corresponds to between 40 and 80% of the wire thickness or of the diameter of the non-flattened segment 43, 53, 63, 73 of the current lead-in wire.

The invention is not limited to the fastening and electrical contacting of doubly coiled incandescent coil filaments with singly coiled ends to current lead-in wires in electric incandescent lamps, but can also be applied to fastening and electrical contacting of electrode coils for fluorescent lamps or other low-pressure discharge lamps. In addition, the invention can also be applied to singly coiled incandescent coil filaments with coiled ends.

What is claimed is:

1. An electric lamp comprising:

a lamp bulb;

at least one incandescent coil filament disposed in the lamp bulb; and electric current leads connected to the incandescent coil filament;

wherein at least one of the current leads is a current lead-in wire;

wherein one end portion of the current lead-in wire is flattened and is U-shaped so as to define a U-shaped end segment having a flattened free leg and a flattened further leg extending from a non-flattened portion of the current lead-in wire;

wherein the at least one incandescent coil filament has a coiled end which is arranged transverse to the flattened legs and which is disposed in a seat defined by a gap between the flattened legs;

wherein the gap has a width which is determined by a degree of flattening of the legs and which is smaller than an outside diameter of the coiled end of the at least one incandescent coil filament.

2. The electric lamp according to claim 1, wherein the width of the gap corresponds to 60% to 90% of the outside diameter of the coiled end of the at least one incandescent coil filament.

3. The electric lamp according to claim 1, wherein the width of the gap corresponds to about 70% of the outside diameter of the coiled end of the at least one incandescent coil filament.

4. The electric lamp according to claim 1, wherein an end portion of one of the legs of the U-shaped end segment of the current lead-in wire is welded to the other of the legs of the U-shaped end segment of the current lead-in wire.

5. The electric lamp according to claim 4, wherein the end portion welded to the other leg is an enlarged portion.

6. The electric lamp according to claim 5, wherein the enlarged portion is non-flattened.

7. The electric lamp according to claim 1, wherein the free leg of the U-shaped end segment of the current lead-in wire is welded to the non-flattened portion of the current lead-in wire.

8. The electric lamp according to claim 7, wherein a free end portion of the free leg is welded to the non-flattened portion of the current lead-in wire.

9. The electric lamp according to claim 7, wherein the flattened further leg has a step formed in a vicinity of where the further leg extends from the non-flattened portion of the current lead-in wire.

10. The electric lamp according to claim 1, wherein the free leg of the U-shaped end segment of the current lead-in wire has an angled end portion which is welded to the flattened further leg of the U-shaped end segment of the current lead-in wire.

11. The electric lamp according to claim 10, wherein the angled end is an angled free end portion of the free leg.

12. The electric lamp according to claim 1, wherein the flattened further leg has a step formed in a vicinity of where the flattened further leg extends from the non-flattened portion of the current lead-in wire.

13. The electric lamp according to claim 1, wherein the flattened further leg has a wire thickness which is between 40% and 70% of a wire thickness of the non-flattened portion of the current lead-in wire.

14. The electric lamp according to claim 1, wherein the at least one incandescent coil filament has an end projecting beyond the legs of the U-shaped segment and which is welded to the current lead-in wire.

15. The electric lamp according to claim 1, wherein the lamp is an electric incandescent lamp, and the at least one incandescent coil filament comprises a doubly coiled incandescent coil filament with singly coiled ends.

16. The electric lamp according to claim 1, wherein the lamp is a low-pressure discharge lamp, and the incandescent coil filament comprises an electrode coil.

* * * * *

UNITED STATES PATENT AND TRADEMARK OFFICE

CERTIFICATE OF CORRECTION

PATENT NO. : 6,191,526 B1
DATED : February 20, 2001
INVENTOR(S) : Minder et al.

It is certified that error appears in the above-identified patent and that said Letters Patent is hereby corrected as shown below:

The title page should be deleted to appear as per attached title page.

Replace drawing sheets 1 & 2 for drawing sheet 1&2 as per attached sheets.

Signed and Sealed this

Eleventh Day of December, 2001

*Attest:*

Nicholas P. Godici

*Attesting Officer*

NICHOLAS P. GODICI
*Acting Director of the United States Patent and Trademark Office*

(12) United States Patent
Minder et al.

(10) Patent No.: US 6,191,526 B1
(45) Date of Patent: Feb. 20, 2001

(54) ELECTRIC LAMP HAVING A CURRENT LEAD-IN WIRE WITH A FLATTENED U-SHAPED END SEGMENT

(75) Inventors: Rolf Minder, Nattheim; Rolf Kiesel, Aalen, both of (DE)

(73) Assignee: Patent-Treuhand-Gesellschaft fuer elektrische Gluehlampen mbH, Munich (DE)

( * ) Notice: Under 35 U.S.C. 154(b), the term of this patent shall be extended for 0 days.

(21) Appl. No.: 09/202,086

(22) PCT Filed: Nov. 11, 1997

(86) PCT No.: PCT/DE97/02639

§ 371 Date: Dec. 8, 1998

§ 102(e) Date: Dec. 8, 1998

(87) PCT Pub. No.: WO98/48448

PCT Pub. Date: Oct. 29, 1998

(30) Foreign Application Priority Data

Apr. 18, 1997 (DE) ..... 197 16 158

(51) Int. Cl.[7] ..... H01J 5/50
(52) U.S. Cl. ..... 313/331; 313/333; 313/271
(58) Field of Search ..... 313/271, 331, 313/333, 578

(56) References Cited

U.S. PATENT DOCUMENTS

| | | | |
|---|---|---|---|
| 2,145,186 | | 1/1939 | Meeker et al. . |
| 2,315,504 | | 4/1943 | Curtis . |
| 3,780,333 | | 12/1973 | Flynn . |

FOREIGN PATENT DOCUMENTS

| | | | | |
|---|---|---|---|---|
| 690 735 | | 4/1940 | (DE) . | |
| 5-182641 | * | 7/1993 | (JP) | H01K/1/16 |
| 6-231736 | * | 8/1994 | (JP) | H01K/1/40 |

* cited by examiner

*Primary Examiner*—Nimeshkumar D. Patel
*Assistant Examiner*—Karabi Guharay
(74) *Attorney, Agent, or Firm*—Frishauf, Holtz, Goodman, Langer & Chick, P.C.

(57) ABSTRACT

The invention relates to the fastening of incandescent coil filaments to current lead-in wires in electric lamps. One end (41) of the current lead-in wires is flattened and U-shaped. The U-shaped segment (41) of the current lead-in wire forms a gap-like seat (45) for a coiled incandescent coil-filament end (*3a*), the gap width of which is smaller than the outside diameter of the incandescent coil-filament end (*3a*).

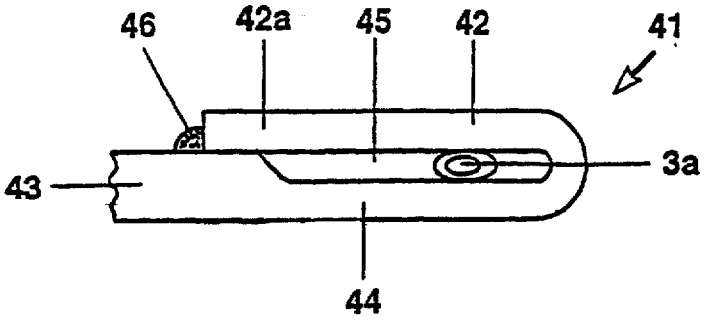

16 Claims, 2 Drawing Sheets